US008814557B2

(12) United States Patent
Bales et al.

(10) Patent No.: US 8,814,557 B2
(45) Date of Patent: Aug. 26, 2014

(54) DIE INSERTS FOR DIE CASTING

(75) Inventors: Daniel A. Bales, Avon, CT (US); Steven J. Bullied, Pomfret Center, CT (US); Carl R. Verner, Windsor, CT (US)

(73) Assignee: United Technologies Corporation, Hartford, CT (US)

( * ) Notice: Subject to any disclaimer, the term of this patent is extended or adjusted under 35 U.S.C. 154(b) by 250 days.

(21) Appl. No.: 12/730,498

(22) Filed: Mar. 24, 2010

(65) Prior Publication Data

US 2011/0233378 A1 Sep. 29, 2011

(51) Int. Cl.

| | |
|---|---|
| ***B22D 17/24*** | (2006.01) |
| ***B29C 39/26*** | (2006.01) |
| ***B28B 7/34*** | (2006.01) |
| ***B22C 9/08*** | (2006.01) |
| ***B22C 9/10*** | (2006.01) |

(52) U.S. Cl.

USPC ..... 425/395; 425/400; 425/403; 425/408; 425/430; 425/466; 249/64; 249/157; 249/165; 164/30; 164/302; 164/340; 164/345; 164/365; 164/370; 164/399

(58) Field of Classification Search

CPC ..... B29C 33/38; B29C 39/26; B29C 41/20; B28B 1/266; B28B 7/34; B22D 17/24; B22D 17/2209; B22D 45/00; B22C 9/08; B22C 9/10; C04B 35/14

USPC ..... 425/395, 400, 403, 408, 466–470, 808, 425/434, DIG. 244; 249/63, 64, 177, 157, 249/159, 163–165, 169; 164/30, 112, 302, 164/340, 369, 370, 397, 341, 345, 365, 399

See application file for complete search history.

(56) References Cited

U.S. PATENT DOCUMENTS

| | | | | | |
|---|---|---|---|---|---|
| 1,370,191 | A | * | 3/1921 | Crate | 249/54 |
| 2,323,014 | A | * | 6/1943 | De Laney | 425/395 |
| 2,339,792 | A | * | 1/1944 | Milano | 425/395 |
| 2,633,603 | A | * | 4/1953 | Huse | 425/215 |
| 3,068,522 | A | * | 12/1962 | Nickerson et al. | 264/275 |
| 3,258,818 | A | * | 7/1966 | Smith | 164/18 |
| 3,380,121 | A | * | 4/1968 | Chittenden et al. | 425/528 |
| 3,409,344 | A | * | 11/1968 | Balint et al. | 359/531 |
| 3,581,804 | A | * | 6/1971 | Woltering | 164/137 |
| 3,680,354 | A | | 8/1972 | Phillips, Jr. | |

(Continued)

FOREIGN PATENT DOCUMENTS

| | | | | | |
|---|---|---|---|---|---|
| JP | 61121915 | A | * | 6/1986 | B29C 45/26 |
| JP | 06055618 | A | * | 3/1994 | B29C 49/48 |
| JP | 2003010957 | A | * | 1/2003 | B22D 17/22 |

OTHER PUBLICATIONS

Translation of JP 06-055618, pp. 1-4, date is not applicable.*

(Continued)

*Primary Examiner* — Dimple Bodawala

(74) *Attorney, Agent, or Firm* — Carlson, Gaskey & Olds P.C.

(57) ABSTRACT

An apparatus for casting material has a die for receiving a compressive force, the die having a shaped-opening for receiving a die insert. The die insert has an exterior shape that is adapted to cooperate with and be received in the opening such that compressive forces impinging upon the die are focused upon the die insert such that tensile forces within the die and impinging upon the die insert are minimized.

8 Claims, 2 Drawing Sheets

(56) References Cited

U.S. PATENT DOCUMENTS

| | | | | | |
|---|---|---|---|---|---|
| 3,844,755 | A | * | 10/1974 | Angle et al. | 65/32.5 |
| 3,905,744 | A | * | 9/1975 | Woodward | 425/471 |
| 4,100,962 | A | * | 7/1978 | Housman | 164/435 |
| 4,167,388 | A | * | 9/1979 | Keelor et al. | 425/387.1 |
| 4,196,769 | A | * | 4/1980 | Feagin | 164/518 |
| 4,309,020 | A | * | 1/1982 | Adams et al. | 249/204 |
| 4,383,672 | A | * | 5/1983 | Kreuttner | 249/134 |
| 4,482,515 | A | * | 11/1984 | Buhler et al. | 264/102 |
| 4,590,026 | A | * | 5/1986 | Goto | 264/221 |
| 4,701,999 | A | | 10/1987 | Palmer | |
| 4,704,079 | A | * | 11/1987 | Pluim, Jr. | 425/190 |
| 4,779,835 | A | * | 10/1988 | Fukushima et al. | 249/161 |
| 4,976,903 | A | * | 12/1990 | Matsuhisa et al. | 264/86 |
| 5,075,053 | A | | 12/1991 | Bernadic et al. | |
| 5,116,450 | A | * | 5/1992 | Spoo et al. | 156/441 |
| 5,723,155 | A | * | 3/1998 | Hayakawa et al. | 425/116 |
| 5,741,446 | A | * | 4/1998 | Tahara et al. | 264/1.9 |
| 5,796,457 | A | | 8/1998 | Ukai et al. | |
| 5,968,302 | A | * | 10/1999 | Gifford | 156/245 |
| 5,989,492 | A | * | 11/1999 | Larsson | 419/36 |
| 5,997,273 | A | | 12/1999 | Laquer | |
| 6,165,407 | A | * | 12/2000 | Tahara et al. | 264/328.1 |
| 6,551,086 | B1 | * | 4/2003 | Tuttle et al. | 425/46 |
| 6,655,843 | B2 | * | 12/2003 | Suzuki | 384/433 |
| 6,746,634 | B2 | * | 6/2004 | Shimakura | 264/1.9 |
| 7,052,264 | B2 | * | 5/2006 | Sudo et al. | 425/188 |
| 7,121,319 | B2 | | 10/2006 | Murray et al. | |
| 7,278,463 | B2 | | 10/2007 | Snyder et al. | |
| 7,323,668 | B2 | | 1/2008 | Benitsch | |
| 7,377,478 | B2 | * | 5/2008 | Tahara et al. | 249/114.1 |
| 7,431,875 | B2 | * | 10/2008 | Rule | 264/272.14 |
| 7,434,432 | B1 | | 10/2008 | Monsees et al. | |
| 2003/0015308 | A1 | * | 1/2003 | Fosaaen et al. | 164/35 |
| 2003/0183985 | A1 | * | 10/2003 | Clegg et al. | 264/328.2 |
| 2004/0217495 | A1 | * | 11/2004 | Takeda | 264/1.1 |
| 2005/0030130 | A1 | * | 2/2005 | Alford | 333/202 |
| 2005/0236729 | A1 | * | 10/2005 | Arnott | 264/71 |
| 2006/0261514 | A1 | * | 11/2006 | Yokota et al. | 264/248 |
| 2007/0264474 | A1 | * | 11/2007 | Filipp et al. | 428/174 |
| 2008/0020081 | A1 | * | 1/2008 | Wilson et al. | 425/116 |
| 2008/0035295 | A1 | * | 2/2008 | Jakus et al. | 164/45 |
| 2008/0299412 | A1 | | 12/2008 | Yang | |
| 2009/0071623 | A1 | * | 3/2009 | Heinrich et al. | 164/137 |
| 2011/0094698 | A1 | * | 4/2011 | Grunstra | 164/33 |

OTHER PUBLICATIONS

Translation of DE 19636968 A1.*

DE 196 36 968 A1, Mar. 1998, Derwent, Friedrich et al.*

* cited by examiner

DIE INSERTS FOR DIE CASTING

BACKGROUND

Investment casting is an industrial process based on one of the oldest metal forming techniques. This process is capable of producing complicated shapes that would be difficult or impossible (particularly with high melting temperature alloys) with die casting. Investment casting produces parts that usually require little surface finishing and only minor machining Usually, the process begins with fabrication of a sacrificial ceramic pattern with the same basic shape as the finished cast part. Patterns are made wax that is injected into a metal injection die. Fabricating the injection die is expensive and can take months of lead time.

Once a wax pattern is produced, it is then dipped in a ceramic slurry, covered with a particulate material, and allowed to dry. Once dried, the pattern is placed in an autoclave to remove the wax. After autoclaving, any remaining wax is burned out in a furnace during which the ceramic shell is also hardened. The mold is then preheated and filled with molten metal, creating the metal casting. Once the casting has cooled sufficiently, the mold shell is chipped away from the casting.

Die casting, on the other hand, is the process of forcing molten metal under high pressure into mold cavities that are machined into dies. Most die castings are made from nonferrous and relatively low melting temperature metals specifically zinc, copper, aluminum, magnesium, lead, and tin-based alloys, although ferrous metal die casts are possible. After the die is filled, and the material therein has solidified, the part for casting is ejected usually by ejector pins. Thereafter, any scrap, which includes gate runners and flash etc. must be separated from the castings.

The dies used in die casting are usually made out of hardest tool steels because cast iron cannot withstand the high pressures involved. Due to this, dies are expensive and may have high start-up costs.

SUMMARY

According to an embodiment disclosed herein, an apparatus for casting material has a die for receiving a compressive force, the die having a shaped-opening for receiving a die insert. The die insert has an exterior shape that is adapted to cooperate with and be received in the opening such that compressive forces impinging upon the die are focused upon the die insert such that tensile forces within the die and impinging upon the die insert are minimized.

According to a feature of the embodiment, the die insert and the shaped opening have a plurality of shaped sides or a continuous side that compressive forces impinging upon the die are focused upon the die insert such that tensile forces within the die and impinging upon the die insert are minimized.

BRIEF DESCRIPTION OF THE DRAWINGS

The various features and advantages of the disclosed examples will become apparent to those skilled in the art from the following detailed description. The drawings that accompany the detailed description can be briefly described as follows.

DETAILED DESCRIPTION OF THE PREFERRED EMBODIMENT

Figure 1:
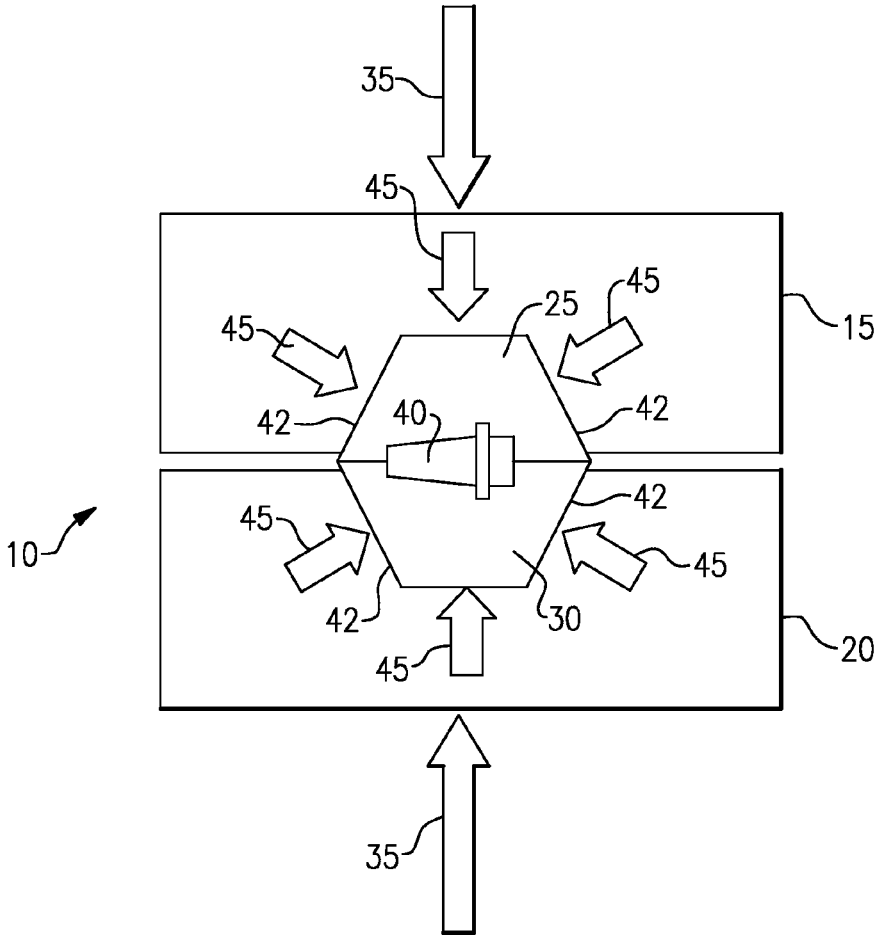
FIG. 1 is a side view of a die having a pair of inserts disclosed therein.

Referring now to FIG. 1 the embodiment of a die 10 is shown. The embodiment includes a top die 15, a bottom die 20, a top die insert 25, a bottom die insert 30. Both dies are driven by a press indicated by arrows 35 that supplies clamping forces that exert high pressure forces on the die inserts 25 and 30 as are known in the art. The use of 150 ton presses and greater are known to be used though lesser tonnage may be used depending on the size of a part 40 to be die cast.

In the instant application, the part 40 created by using the dies and die inserts is made of a high temperature nickel alloy that has a melting point around 2800° F.-2900° F. though other high temperature and low temperature alloys may be used herein. The die inserts are typically made of a ceramic material like silicon nitride which can withstand temperatures up to 5000° F. Silicon nitride has enviable properties like high strength over a wide temperature range, fracture toughness, high hardness, outstanding wear resistance, thermal shock resistance and chemical resistance. However other materials are known and are contemplated for use herein.

The upper and lower die inserts 25, 30 fit very snuggly within the upper and lower dies 15, 20 and have tapered or contoured sides 42 so that operation of the presses force the top die and the bottom die to provide the uniform compressive forces indicated by arrows 45 upon the upper and lower die inserts 25, 30. Ceramic materials, like silicon nitride, have very low ductility and compressive forces are ideally tolerated by the material while tensile forces are not as well tolerated. By providing the uniform compressive force caused by the contoured sides on the die inserts, which focus the compressive forces on the upper and lower die inserts 25, 30, any tensile forces, which might damage the die inserts 15, 20, on the die inserts are minimized and die life is therefore maximized.

Referring now to FIG. 2, several alternative embodiments of the die inserts 2A, 2B and 2C a side view of lower die 20 and lower die insert 30, and a bottom view of the top die insert 25 are shown.

Figures 2A, 2B, 2C:
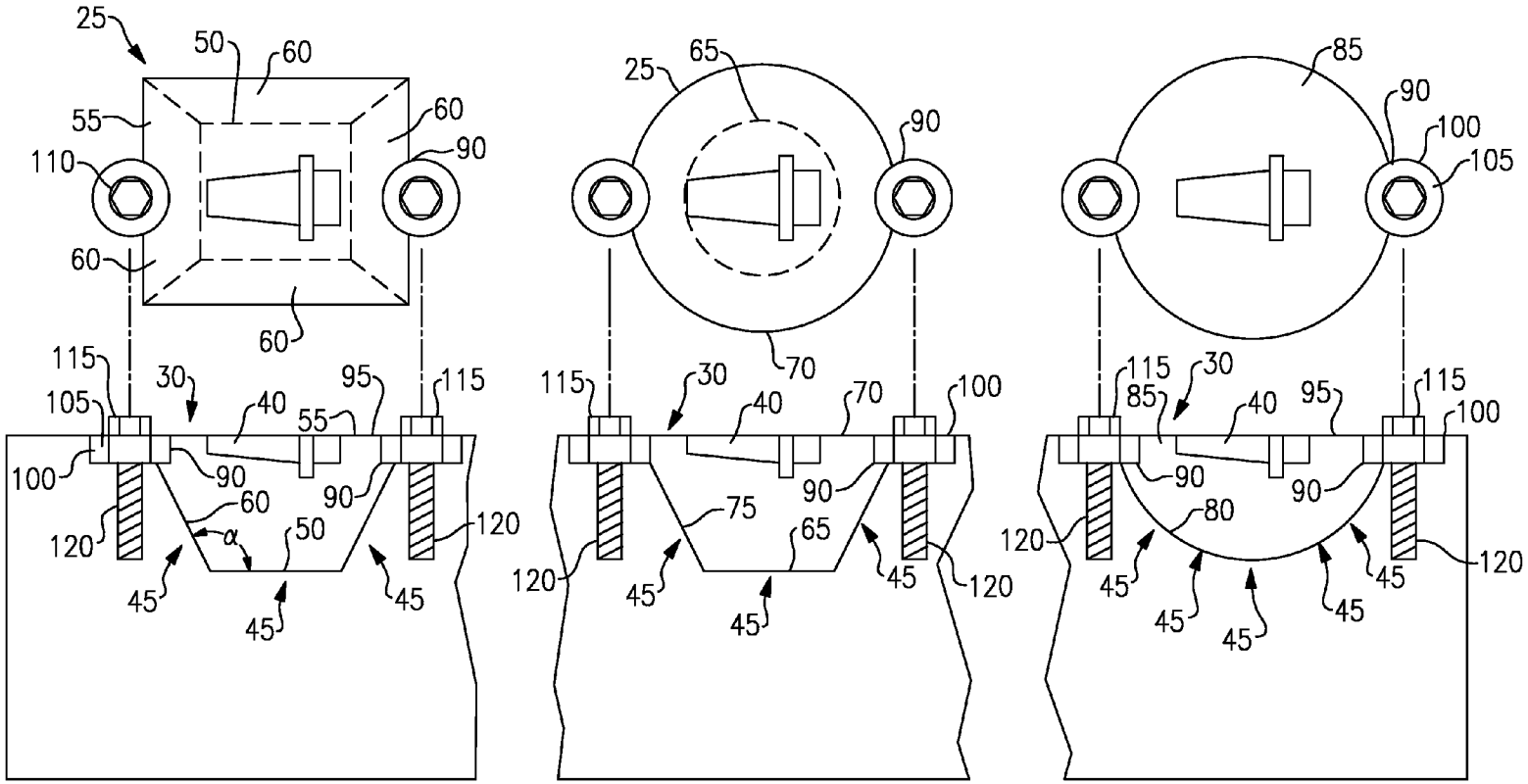
FIG. 2A shows top and side views of a second embodiment of a die insert of FIG. 1.
FIG. 2B shows top and side views of a third embodiment of a die insert of FIG. 1.
FIG. 2C shows top and side views of a fourth embodiment of a die insert of FIG. 1.

In FIG. 2A, the upper die insert 25 has a rectangular top portion 50, a rectangular bottom portion 55 and four angled side surfaces 60 that attach the top portion 50 to the bottom portion 55. Similarly, the lower die insert 30 mirrors the upper die insert 25.

In FIG. 2B, upper die insert has a circular top portion 65, a circular bottom portion 70 and a conical side surface 75 joining the top portion 65 to the bottom portion 70 so that the die looks like a truncated cone. Similarly, the lower die insert 30 mirrors the upper die insert 25.

In FIG. 2C, upper die insert has a bowl-shaped top and side portion 80 and a circular face portion 85 so that the die looks like a bowl. Similarly, the lower die insert 30 mirrors the upper die insert 25.

Ideally the side surface forms an angle $\alpha$ that is greater than 90° between the side surface 60 and the top surface 50 (see FIG. 2A).

Each upper and lower die insert in FIGS. 2A, 2B, and 2C have a pair of shoulders 90 in a mating surface 95 thereof and a side surface 60, 75, 80 thereof so that a screw 100 will mate with the top surface and the side surface to hold the upper and lower die insert 25, 30 in the upper and lower dies 15, 20 respectively.

Screw 100 has a large head 105 in which a counter sink 110 is disposed therein. In the embodiment shown, the counter sink 110 is hexagonally-shaped to receive a hexagonally-shaped pin 115 that extends radially from the large head 105 and locates the upper die 15 atop the lower die 20. The screws mate with holes 120 within the upper and lower dies 15, 20.

Alternatively, the pins 115 may be set or manufactured within the screw 105 so that one screw 105 disposed in the bottom die 20 would, for instance, mate with the screw counter sink 110 in the upper die 15 or vice-versa. Other locating devices and other shaped countersinks are contemplated for use herein.

In operation, the upper die insert 25 is inserted into a top die 15 and a bottom die insert 30 is placed in the bottom die 20. The inserts are secured to the dies by screws 100 that fit into holes 120 and the enlarged screw head 100 holds the shoulders 90 of the upper and lower die inserts 25, 30 securely in the upper and lower dies 15, 20. The top die insert and the bottom die insert are then aligned via the pins 115 that are inserted into countersinks 110. Liquid metal is then injected at high temperature between the dies into the die cavity to create a part 40.

Although a combination of features is shown in the illustrated examples, not all of them need to be combined to realize the benefits of various embodiments of this disclosure. In other words, a system designed according to an embodiment of this disclosure will not necessarily include all of the features shown in any one of the Figures or all of the portions schematically shown in the Figures. Moreover, selected features of one example embodiment may be combined with selected features of other example embodiments.

The preceding description is exemplary rather than limiting in nature. Variations and modifications to the disclosed examples may become apparent to those skilled in the art that do not necessarily depart from the essence of this disclosure. The scope of legal protection given to this disclosure can only be determined by studying the following claims.

What is claimed is:

1. An apparatus for casting metallic material, said apparatus comprising:

a first die receiving an exterior compressive force, said compressive force molding a part, said die having a shaped-opening for receiving a die insert, and said die insert having an exterior shape with contoured sides, said die insert adapted to cooperate with and be received in said opening such that compressive forces impinging upon said first die are focused upon said die insert and its contoured sides such that tensile forces within said die insert are minimized, wherein said contoured sides are angled from a flat surface within said die to a mating surface with an adjacent, second die, wherein said contoured sides are angled at greater than 90° relative to said flat surface, and wherein said die insert is constructed of a material that withstands temperatures greater than 2800° F. without melting, and a first fastener impinging upon a shoulder of said die insert, said first fastener attaching to said first die to hold said die insert within said first die, wherein said fastener is a first screw having a first head resting on said shoulder, and having a body anchored to said first die, wherein said screw head has an indentation receiving a pin extending from a second screw head aligned in said adjacent second die, said indentation and said pin aligning said first die and said second die.

2. The apparatus of claim 1 wherein said die insert is constructed of a ceramic material.

3. The apparatus of claim 2 wherein said ceramic material is silicon nitride.

4. The apparatus of claim 1 wherein said first die and said second die are adapted for use with parts made of a high temperature nickel alloy.

5. An apparatus for casting material, said apparatus comprising:

a first die receiving an exterior compressive force, said compressive force molding a part, and said first die having a shaped-opening for receiving a die insert, said die insert having an exterior shape that is adapted to cooperate with and be received in said opening such that compressive forces impinging upon said first die are focused upon said die insert such that tensile forces impinging upon said die insert are minimized wherein said die insert has a shoulder holding said die insert within said first die, wherein said die insert is constructed of a ceramic material, and a first fastener impinging upon said shoulder and attaching to said first die holding said die insert within said first die wherein said first fastener having a first head resting on said shoulder and having a body anchored to said first die, and wherein said first fastener has an indentation receiving a pin extending from a second fastener aligned within an adjacent second die, said pin and said indentation aligning said first die and said adjacent second die.

6. The apparatus of claim 5 wherein said first fastener is a screw.

7. The apparatus of claim 5 wherein said second fastener is a screw with a pin extending therefrom.

8. The apparatus of claim 5 wherein said ceramic material is silicon nitride.

* * * * *